US005300409A

United States Patent [19]

Ushiroyama et al.

[11] Patent Number: 5,300,409

[45] Date of Patent: Apr. 5, 1994

[54] METHOD FOR PROCESSING A DYE CONTAINING SILVER HALIDE PHOTOGRAPHIC LIGHT-SENSITIVE MATERIAL

[75] Inventors: Hiroyuki Ushiroyama; Kazuhiro Yoshida, both of Hachioji, Japan

[73] Assignee: Konica Corporation, Tokyo, Japan

[21] Appl. No.: 611,285

[22] Filed: Nov. 9, 1990

[30] Foreign Application Priority Data

Nov. 13, 1989 [JP] Japan ..... 1-294430

[51] Int. Cl.[5] ..... G03C 1/76; G03C 1/825; G03C 1/83

[52] U.S. Cl. ..... 430/428; 430/510; 430/513; 430/517; 430/522; 430/523; 430/642

[58] Field of Search ..... 430/510, 513, 517, 522, 430/523, 398, 428, 372, 642

[56] References Cited

U.S. PATENT DOCUMENTS 4,855,218 8/1989 Fujita et al. ..... 430/428
5,057,406 10/1991 Usagawa et al. ..... 430/522

FOREIGN PATENT DOCUMENTS 3195656 8/1988 Japan ..... 430/522
1-280750 11/1989 Japan .

OTHER PUBLICATIONS

Patent Abstracts of Japan vol. 12 No. 480 (p-801) (3327) Dec. 15, 1988 JP-A-63/195656.

*Primary Examiner*—Lee C. Wright
*Attorney, Agent, or Firm*—Finnegan, Henderson, Farabow, Garrett & Dunner

[57] ABSTRACT

A method of processing a light-sensitive silver halide photographic material is disclosed. The method comprises a processing steps of developing, fixing and a washing or stabilizing, wherein a replenishing solution for the washing or the stabilizing step is an amount of not more than 3 liters per square meter of the light-sensitive material. The photographic material comprises a support, and a hydrophilic colloidal layer on each of the both side of the support, wherein either one of the hydrophilic colloidal layers contains a dye represented by a specific chemical formula.

1 Claim, No Drawings

METHOD FOR PROCESSING A DYE CONTAINING SILVER HALIDE PHOTOGRAPHIC LIGHT-SENSITIVE MATERIAL

FIELD OF THE INVENTION

This invention relates to a method of processing a silver halide photographic light-sensitive material and, particularly, to a method of processing a silver halide photographic light-sensitive material containing a specific dye.

BACKGROUND OF THE INVENTION

Heretofore, a variety of dyes have been used for the various purposes, in silver halide photographic light-sensitive materials.

For example, there have been some instances where a colored layer so-called a filter layer may generally be provided to the outside of a light-sensitive emulsion layer,—that is, to the side thereof far from a support-. The filter layer is provided thereto when it is required to control the spectral composition of rays of light incident to the light-sensitive emulsion layer. When a plurality of the light-sensitive emulsion layers are provided as in a multilayered color light-sensitive material, there may be some instances where the filter layer may be interposed between the emulsion layers.

For preventing a halation, there may also be some instances where a colored layer is arranged either between a light-sensitive emulsion layer and a support or to the side of the support opposite to the light-sensitive emulsion layer. The arrangements are to inhibit the so-called halation, that is, an image blur produced by reason that a beam of incident light is scattered when or after passing through a light-sensitive emulsion layer and the scattered light is reflected on either the interface between the emulsion layer and the support or the surface of the light-sensitive material on the opposite side of the emulsion layer and the reflected light is incident again into the emulsion layer. The layer so arranged as above is called an antihalation layer. In the case of multilayered color light-sensitive materials, there may be some instances where the antihalation layers may be arranged each between the other layers.

Besides the above, the emulsion layers are sometimes so colored as to prevent an irradiation which makes an image-sharpness lowered by the rays of light scattered in the emulsion layers.

As mentioned above, a desired wavelength of light is absorbed by coloring the silver halide emulsion layers and other layers.

There may be some instances where a light-sensitive material provided thereonto with various kinds of colored layers may be unnecessarily colored, because a dye used for the coloration remains in the light-sensitive material already processed. It is, therefore, desired that the dye used for forming a colored layer should be decolored in the course of processing the light-sensitive material or should be removed by dissolving it in the course of processing the light-sensitive material so that the color may not remain in the light-sensitive material.

On the other hand, however, when using a dye capable of being dissolved out in the course of processing the light-sensitive material, there may be some instances where a sludge may be produced in a processing solution so as to produce a film-stain on the light-sensitive material subject to a processing treatment.

Besides the above, for the dye applicable to the colored layers of a light-sensitive material, it is required not only to satisfactorily perform a desired spectral absorption, but also not to affect the photographic characteristics of the light-sensitive material. However, none of the proposals was made for the techniques which can satisfy the above-mentioned requirements and can satisfactorily solve the above-mentioned problems of the remaining color and the stains produced by the sludge.

SUMMARY OF THE INVENTION

An object of the invention to provide a method of processing a silver halide photographic light-sensitive material, wherein the problem of the remaining color can be solved and the stain cannot be produced by a sludge, as well as a colored layer having desired characteristics can be formed.

The method of processing a light-sensitive material comprises the processing steps of developing and fixing steps; and after carrying out the developing and fixing steps, a washing step or a stabilizing step wherein a replenishing solution for the washing or stabilizing steps is an amount of not more than 3 liters per sq. meter of the light-sensitive material. The silver halide photographic light-sensitive material comprises a support having at least one hydrophilic colloidal layer on each side of the support and at least either one of the hydrophilic colloidal layers contains at least one kind of the dyes selected from the group consisting of the compounds represented by the following formulas Ia, Ib and Ic detailed later.

DETAILED DESCRIPTION OF THE INVENTION

First, the dyes of the invention represented by Formulas Ia, Ib and Ic will be detailed.

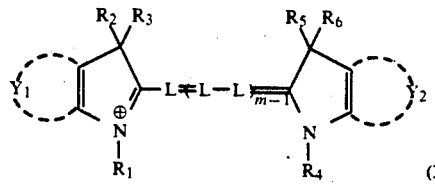

Formula Ia

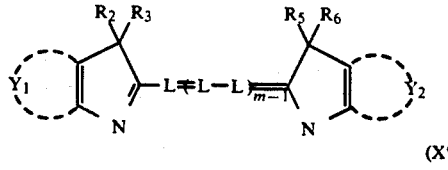

Formula Ib

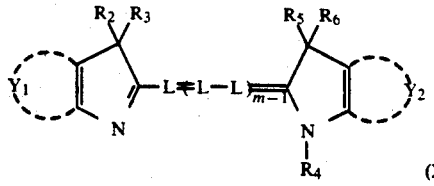

Formula Ic wherein $R_1$, $R_2$, $R_3$, $R_4$, $R_5$ and $R_6$ represent each an alkyl group; and $Y_1$ and $Y_2$ represent each the group consisting of non-metal atoms necessary to form a pyrrolopyridine ring. In the ring represented by $Y_1$ of Formulas Ib and Ic, a bond of

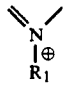

is contained, and in the ring represented by $Y_2$ of the same formulas, a bond of

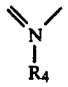

is contained.

In Formulas Ia, Ib and Ic, wherein at least two of $R_1$, $R_2$, $R_3$, $R_4$, $R_5$, $R_6$, $Y_1$ and $Y_2$ represent are acid groups, or at least two of $R_1$, $R_2$, $R_3$, $R_4$, $R_5$, $R_6$, $Y_1$, and $Y_2$, are substituents having at least one group of the formula $—CH_2CH_2OR$ in which R represents a hydrogen atom or an alkyl group;

L represents a methine group; $X^{\ominus}$represents an anion; m is an integer of 4 or 5; and n is an integer of 1 or 2; provided, n is 1 when the dye forms an intramolecular salt.

In Formulas Ia, Ib and Ic, the acid groups include, for example, a sulfonic acid group, a carboxylic acid group and a phosphoric acid group, and the acid groups also include the salts thereof. The salts thereof include, for example; alkali-metal salts such as those of sodium and potassium; and organic ammonium salts such as those of ammonium, triethylamine and pyridine.

The alkyl groups represented by $R_1$, $R_2$, $R_3$, $R_4$, $R_5$ and $R_6$ include, preferably, lower alkyl groups each having 1 to 8 carbon atoms, such as a methyl, ethyl, propyl, i-propyl or butyl group, and they may have any other substituents than the above-given acid substituents or the $—CH_2CH_2OR$ groups.

The alkyl groups represented by R include, preferably, a lower alkyl group having not more than 4 carbon atoms.

The substituents containing the $—CH_2CH_2OR$ groups include, for example, a hydroxyethyl group, a hydroxyethoxyethyl group, a methoxyethoxyethyl group, a hydroxyethylcarbamoylmethyl group, a hydroxyethoxyethylcarbamoylmethyl group, an N,N-dihydroxyethylcarbamoylmethyl group, a hydroxyethylsulfamoylethyl group, and a methoxyethoxyethoxycarbonylmethyl group.

The other substituents which $Y_1$ and $Y_2$ may have include, for example, sulfo groups including the salts thereof, a carboxyl groups including the salts thereof, a hydroxyl group, a cyano group, and halogen atoms such as those of fluorine, chlorine and bromine.

The methine groups represented by L are each also allowed to have a substituent. The substituents include, for example; substituted or non-substituted lower alkyl groups each having 1 to 5 carbon atoms, such as a methyl, ethyl, 3-hydroxypropyl or 2-sulfoethyl group; halogen atoms such as those of fluorine, chlorine and bromine; aryl groups such as a phenyl group; and alkoxy groups such as a methoxy or ethoxy group. It is also allowed that each of the substituents of the methine group are bonded together to form a 6-membered ring such as a 4,4-dimethylcyclohexene ring.

There is no special limitation to the anions represented by $X^{\ominus}$. The typical examples thereof include a halogen ion, a p-toluenesulfonic acid ion and an ethylsulfuric acid ion.

The dyes applicable to the invention, which are represented by the aforegiven formulas Ia, Ib and Ic, will be exemplified below. It is, however, to be understood that the invention shall not be limited thereto.

Among the typical compounds exemplified below, the exemplified compounds (3), (4), (10) to (13), (19), (20), (23), (26), (29) and (32) are the dyes represented by formula Ia; (1), (2), (5) to (9), (14) to (18), (21), (22), (24), (25), (27), (31) and (33) are the dyes represented by formula Ib; and (28) and (30) are the dyes represented by formula Ic.

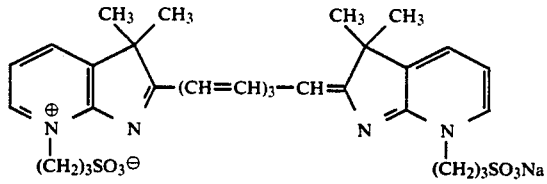

(1)

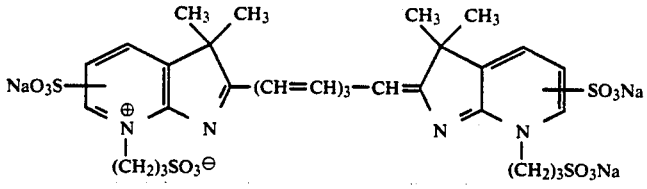

(2)

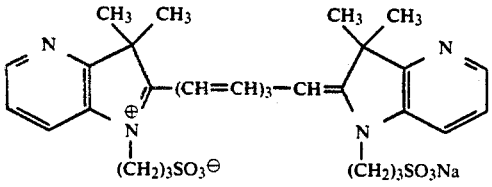

(3)

-continued
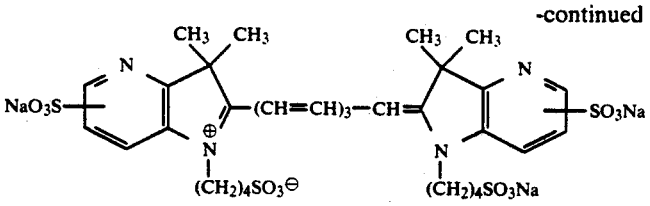
(4)
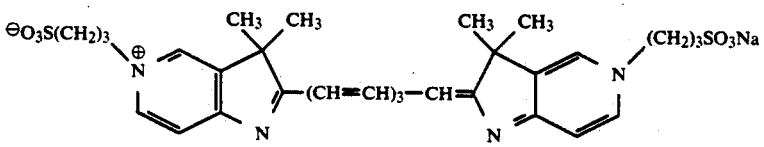
(5)
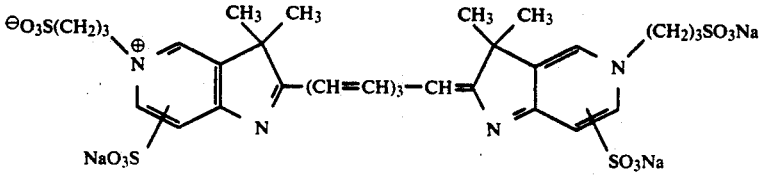
(6)
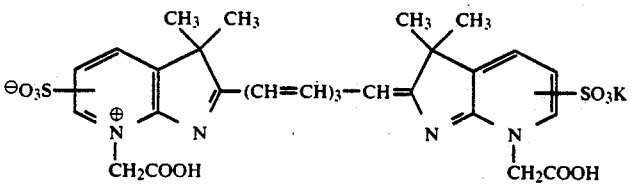
(7)
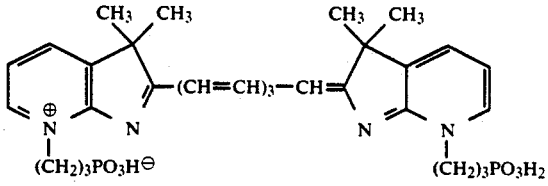
(8)
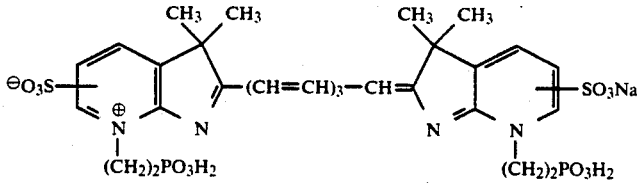
(9)
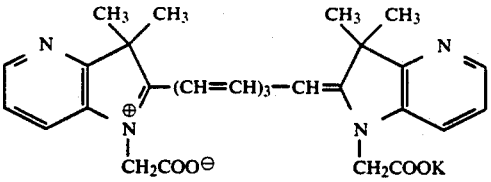
(10)
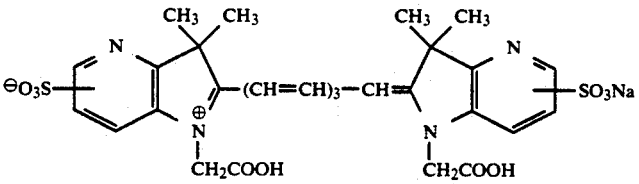
(11)
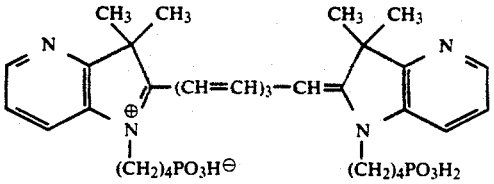
(12)

-continued
(13)
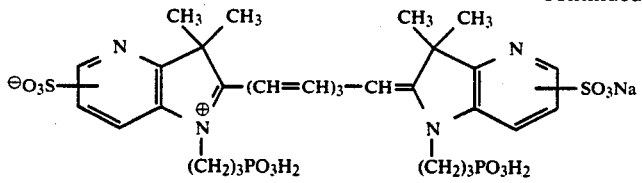
(14)
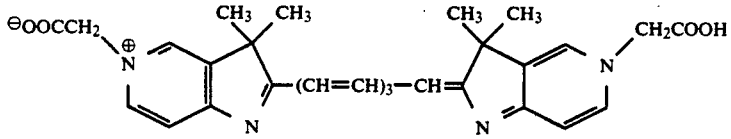
(15)
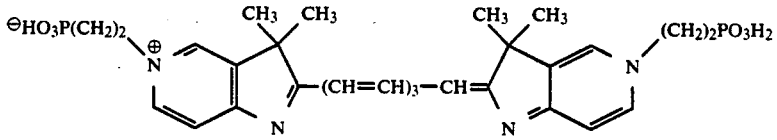
(16)
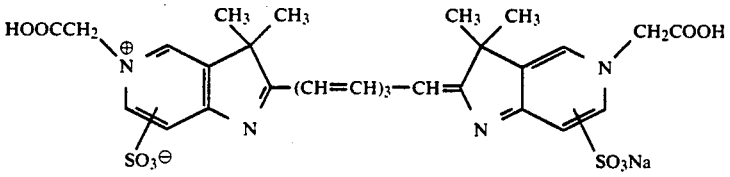
(17)
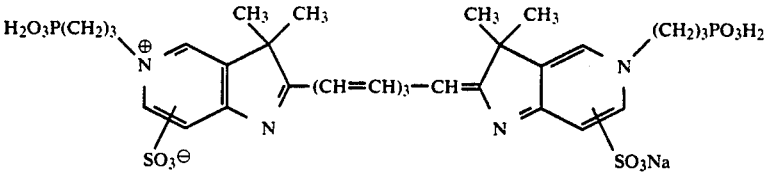
(18)
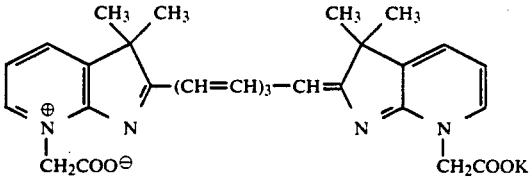
(19)
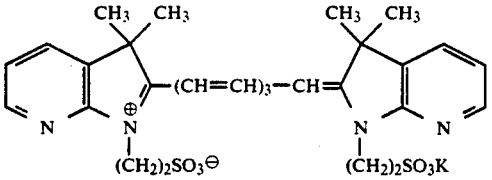
(20)
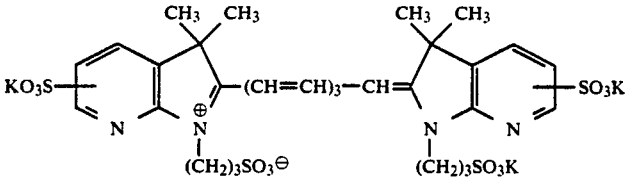
(21)
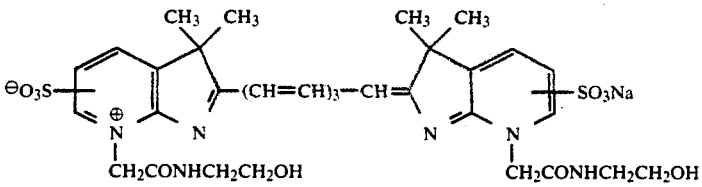

-continued
(22)
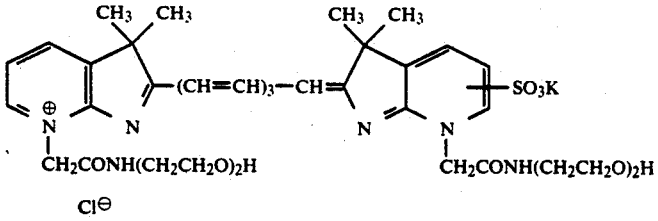
(23)
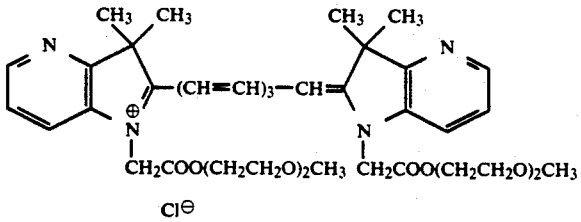
(24)
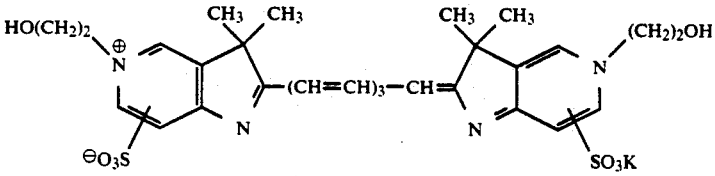
(25)
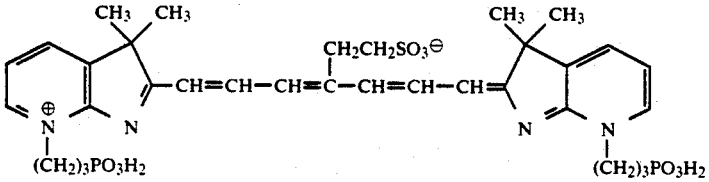
(26)
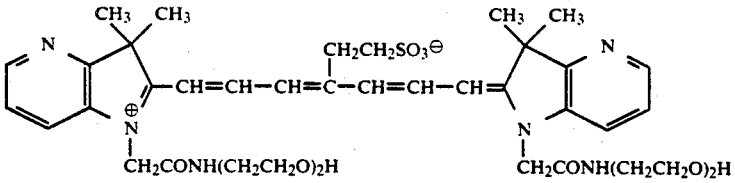
(27)
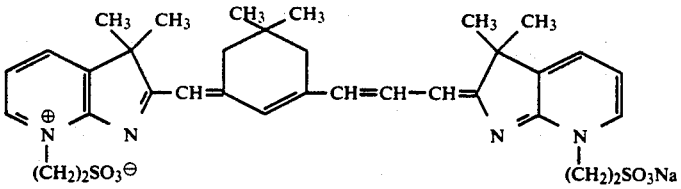
(28)
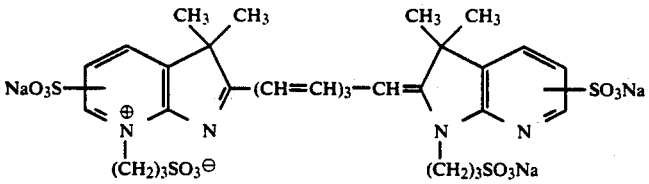
(29)
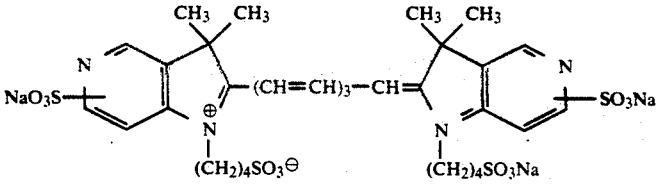

-continued

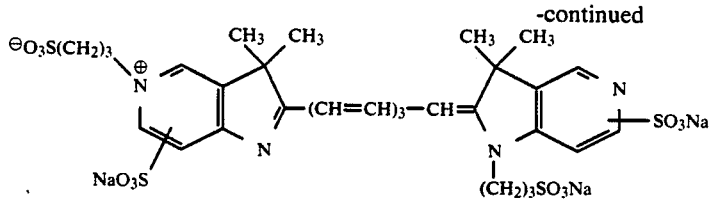
(30)

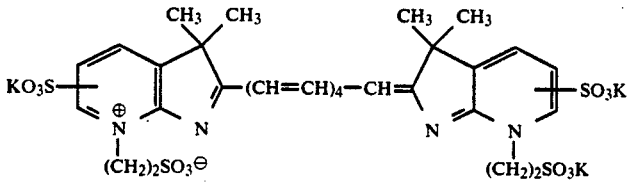
(31)

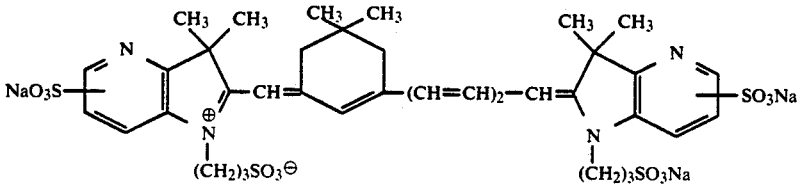
(32)

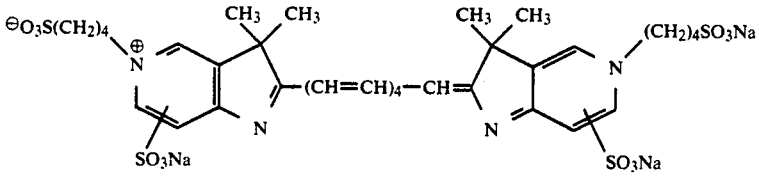
(33)

The dyes of the invention may be synthesized with reference to the descriptions in Journal of the Chemical Society, p. 128, 1933, U.S. Pat. No. 2,895,955, and Japanese Patent Publication Open to Public Inspection -hereinafter referred to as Japanese Patent O.P.I. Publication-No. 62-123454/1987, for example.

The compounds capable of forming the mother nuclei of the dyes of the invention include, for example, the following compounds:

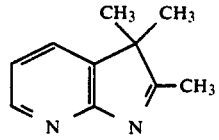
(A)

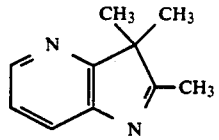
(B)

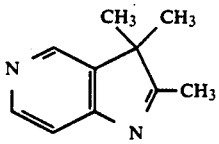
(C)

Compound (A) may be synthesized in the methods described in, for example, Journal of the Chemical Society, 3202, 1959 and British Patent No. 870,753.

Compound (B) may be synthesized in the method described in, for example, Journal of the Chemical Society, 584, 1961.

Compound (c) may be synthesized in the method described in, for example, British Patent No. 841,558.

If required, the above-mentioned mother nuclei are allowed to be made quarternary or subject to a sulfonation. Or, a 1-alkyl substituted-3H-pyrrolopyridine derivative may also be used as a starting material which is prepared in accordance with the synthesization methods described in Journal of the Chemical Society, 3202, 1959 and, ibid., 584, 1961, in which a cyclization reaction is carried out through hydrazone having synthesized an N-alkyl-N-pyridylhydrazine and, if required, an acid treatment is carried out.

Each of the above-mentioned dyes may be used in such a manner that it is dissolved in any one of suitable solvents including, for example, alcohol such as methanol or ethanol, and the resulting solution is added into a hydrophilic colloidal layer coating solution for forming a desired colored layer of a light-sensitive material.

In the invention, a light-sensitive material subject to treatments is required to contain at least anyone kind of the compounds represented by formulas Ia, Ib or Ic. It is also allowed to use not less than two kinds of the compounds in any combination such as either any combination of the compounds each represented by the same formula or any combination of the compounds each represented by the different formulas.

The amounts of the dyes used therein can hardly be determined indiscriminately because the amounts thereof are varied to meet the purposes of application. However, the amount of the dyes may be selectively determined to be used in an amount within the range of, generally, $10^{-3}$ g/m$^2$ to 1.0 g/m$^2$ and, preferably, $10^{-2}$ g/m$^2$ to 0.5 g/m$^2$.

The dyes of the invention represented by the aforegiven formulas Ia, Ib and Ic may be used in various kinds of colored layers. For example, they are particularly effective when using them for the purpose of preventing an irradiation. When this is the case, the dyes are used by adding them mainly in silver halide emulsion layers.

The dyes of the invention are also particularly effective to be used for preventing a halation. When this is the case, they are used by adding them generally in the rear side of a support or a layer arranged between the support and an emulsion layer.

The dyes of the invention may also be used as the dyes for giving a safelight a safety. When this is the case, they are generally used by adding them in a layer, such as a protective layer, arranged to the upper part of a silver halide emulsion and, if required, in combination with the other dyes capable of absorbing rays of light having other wavelengths.

Besides the above, the dyes of the invention may be used advantageously as filter dyes.

When carrying out the processing method of the invention, the gelatin contents of a light-sensitive material subject to the treatments on the side thereof containing the dyes of the invention is not more than 3.5 $g/m^2$ and, preferably, not more than 3.0 $g/m^2$.

In the light-sensitive material subject to the treatments, the swelling degrees thereof after completing a fixing step are preferably not more than 150% and, particularly, not more than 100%.

The above-mentioned swelling degree thereof can be obtained in the following manner: (a) a light-sensitive material subject to the treatments is rehumidified for 3 days under the conditions of a temperature of 25° C. and a relative humidity of 50%; (b) the thickness of the hydrophilic colloidal layer thereof is measured; (c) the light-sensitive material is ordinarily treated in a developing fixing means; and (d) the percentages of the layer thickness variations are measured in comparison with the hydrophilic colloidal layer thickness measured in the above-mentioned step (b).

In the processing method of the invention, the washing or stabilizing time is preferably not longer than 15 seconds and, particularly, not longer than 10 seconds.

Next, light-sensitive materials subject to the treatments will be further detailed. The light-sensitive materials are allowed to contain the dyes of the invention inat least anyone of the silver halide emulsion layers and/or the other hydrophilic colloidal layers, and the other constitution thereof shall not be specially limitative. For example, as the silver halides applicable to the silver halide emulsion layers thereof, anyone of silver halides applicable to ordinary silver halide emulsions may be used, such as silver bromide, silver chloride, silver iodobromide, silver chlorobromide and silver chloroiodobromide.

It is preferable to use a silver halide emulsion having a silver chloride content of not less than 50 mol %.

The average grain-sizes of the silver halide grains are preferably not larger than 0.4 μm. The grain-sizes thereof may be defined and measured in accordance with the definition and the measuring method each described later, respectively.

The silver halide grains applicable thereto may be obtained in anyone of the acidic, neutral and ammoniaal methods.

The silver halide grains may be those having a uniform distribution of silver halide composition in the grains or those of the core/shell type having the different distributions between the inside of the grains and the surface layer of the grains. Further, the grains may be those capable of forming a latent image mainly on the surfaces of the grains or those capable of forming a latent image mainly inside the grains.

In the light-sensitive material, silver halide grains having any configurations may be used.

One of the preferable examples thereof is that having (100) faces as the crystal faces thereof.

In particular, it is preferable to use silver halide grains each having a ratio of (100) faces to (111) faces of not less than 5, and the grains having (100) faces of 100% may also be used.

The ratios of the (100) faces of the grain to the (111) faces thereof may be measured in Kubelka-Munk's dye-adsorption method.

This type of dye-adsorption method are carried out by selectively using a dye which is capable of adsorbing preferentially to either the (100) faces of grains or the (111) faces thereof and is different spectrally in the associated states of the dye between the (100) faces and the (111) faces. When adding such a dye as described above into an emulsion and precisely inspecting the spectra corresponding to the amounts of the dye added, the ratio of (100) faces to (111) faces may be determined.

The precise ratios of the (100) faces of the surfaces of silver halide grains may be obtained in the method detailed in Tadaaki Tani, 'The Identification of the Crystal Phases of Fine Silver Halide Grains in a Photographic Emulsions, Utilized the Adsorption Phenomena of Dyes', Bulletin of the Chemical Society of Japan, 6, pp. 942–946, 1984.

The preferable silver halide grains having a ratio of (100) faces to (111) faces of not less than 5 may be prepared in various methods. Generally, they may be preferably prepared in the so-called controlled double-jet method in which the pAg value is kept constant to be not higher than 8.10 in the course of growing grains and both of an aqueous silver nitrate solution and an aqueous alkali halide solution are simultaneously added upon selecting the rate which is faster than the dissolving rate of the grains and faster in nuclear reproduction. In this case, the pAg value is, preferably, not higher than 7.80 and, particularly, not higher than 7.60. Providing that the formation of silver halide grains is separated into two processes, namely, the formation of nuclei and the growth of nuclei, there is no limitation to the pAg values in the formation of nuclei and the pAg values in the growth of nuclei are, desirably, not higher than 8.10, preferably, not higher than 7.80 and, particularly, not higher than 7.60. A soluble silver salt may be reacted with a soluble halogen salt in a single jet precipitation method. It is, however, preferable for obtaining an excellent monodispersibility to use a double-jet precipitation method.

It is also allowed to use octahedral, tetradecahedral or dodecahedral grains prepared in the methods described in U.S. Pat. Nos. 4,183,756 and 4,225,666; Japanese Patent O.P.I. Publication No. 55-26589/1980; Japanese Patent Examined Publication No. 55-42737/1980; and The Journal of Photographic Science, 21. 39, 1973. Besides the above, the grains having twi-crystal faces may also be used.

It is allowed to use silver halide grains having either a single configuration or various configurations mixed therein.

It is also allowed to use an emulsion having any grain-size distributions, or an emulsion having a broard grain-size distribution—hereinafter called a polydisperse type emulsion—It is further allowed to use emulsions each having a narrow grain-size distribution —hereinafter called monodisperse type emulsions—independently or in combination. Besides, it is allowed to use a mixture of both of the polydisperse type emulsion and the monodisperse type emulsion.

The silver halide emulsions may be used in the form of a mixture of not less than two kinds of emulsions each separately prepared.

The term, an average grain-size r, herein stated is defined as a grain-size ri, when maximizing a product, $ni \times ri^3$, of a frequency ni of a grain having a grain-size ri and $ri^3$.

The term, a grain-size, herein stated means a grain diameter when the grain is globular-shaped, and a diameter of a circular image obtained by converting a projective image into the circular image having the same area as that of the projective image.

Such a grain-size as mentioned above may be obtained in the manner, for example, that a grain is photographed after magnifying it 10000 to 50000 times by a electron microscope and the diameter of the grain image on the resulting print or the area of the projective image of the grain is practically measured; provided, the number of the grains subject to the measurement is deemed to be not less than 1000 grains.

The particularly preferable monodisperse type emulsions of the invention have a monodispersion degree of not higher than 20 and, preferably, not higher than 15. The monodispersion degrees are defined by the following equation:

$$\frac{\text{Standard grain-size deviation}}{\text{Average grain-size}} \times 100 = \text{Monodispersion degree}$$

Wherein the average grain-size and the standard grain-size deviation shall be obtained from the above-defined ri.

Such a monodisperse type emulsion may be prepared with reference to Japanese Patent O.P.I. Publication Nos. 54-48521/1979, 58-49938/1983 and 60-122935/1985.

The light-sensitive silver halide emulsions may be used as they are still primitive without any chemical sensitization, however, they are usually chemically sensitized. Such a chemical sensitization may be carried out in the methods described in, for example, the books authored by Glafkides, Zelikman et al, or H. Frieser, 'Die Grundlagender Photographischen Prozesse mit Silberhalogeniden', Academische verlagsgesellschaft, 1968.

To be more concrete, the chemical sensitization methods applicable thereto include, for example, a sulfur-sensitization method using a sulfur-containing compound capable of reacting with silver ions; a reduction-sensitization method using a reducible substance; and a noble-metal-sensitization method using gold or the other noble metals. The sulfur-sensitizers applicable thereto include, for example, a thiosulfate, a thiourea, a thiazole, a rhodanine and other compounds. The typical examples thereof are given in U.S. Pat. Nos. 1,574,944, 2,410,689, 2,278,947, 2,728,668 and 3,656,955. The reduction-sensitizers applicable thereto include, for example, a stannous salt, an amine, a hydrazine derivative, formamidosulfinic acid and a silane compound. The typical examples thereof are given in U.S. Pat. Nos. 2,487,850, 2,419,974, 2,518,698, 2,983,609, 2,983,610 and 2,694,637. The noble-metal sensitizers applicable thereto include, for example, a gold complex salt and the metal complex salts such as platinum, iridium and palladium each belonging to Group VII of periodic table. The typical examples thereof are given in U.S. Pat. Nos. 2,399,083 and 2,448,060 and British Patent No. 618,061.

There is no special limitation to the conditions for the chemical sensitization, such as pH, pAg and temperature requirements. However, the pH values are within the range of, desirably, 4 to 9 and, preferably, 5 to 8; the pAg values are within the range of, desirably, 5 to 11 and, preferably, 7 to 9; and the temperatures are within the range of, desirably, 40 to 90° C. and, preferably, 45° to 75° C.

The silver halide emulsions applicable thereto may be sensitized in the sulfur-sensitization method, a gold sulfur-sensitization method, the reduction-sensitization method using a reducible substance, and the noble-metal-sensitization method using a noble-metal compound, independently or in combination.

As for the light-sensitive emulsions, the foregoing emulsions may be used independently or in combination in the form of the mixture thereof.

When embodying the invention, a variety of stabilizers including, for example, 4-hydroxy-6-methyl-1,3,3a,7-tetrazaindene, 5-mercapto-1-phenyltetrazole and 2-mercaptobenzothiazole, may be used after completing such a chemical sensitization as mentioned above. Further, if required, silver halide solvents such as thioether, or crystal habit controllers such as a mercapto group-containing compound and sensitizing dyes may also be used.

Into the silver halide grains, metal ions may be added in the course of forming the grains and/or growing them, by making use of a cadmium salt, a zinc salt, a lead salt, an iridium salt or the complex salts thereof, a rhodium salt or the complex salts thereof, or an iron salt or the complex salts thereof, so that the metal ions may be contained in the inside and/or the surface of each grain.

From the emulsions, any unnecessary soluble salts may be removed after completing the growth of the silver halide grains, or such unnecessary salts may remain in the emulsions as they are. When removing the salts mentioned above, it is allowed to remove them in accordance with the method detailed in Research disclosure, No. 17643.

The silver halide photographic light-sensitive materials applicable to the invention may be those used a sensitizing dye therein. The dyes applicable thereto include, for example, a cyanine dye, a melocyanine dye, a compound cyanine dye, a compound melocyanine dye, a holopolar cyanine dye, a hemicyanine dye, a styryl dye and a hemioxanol dye. Among them, the particularly useful dyes include, for example, those belonging to the cyanine dyes, melocyanine dyes and compound melocyanine dyes.

To the above-given dyes, it is allowed to use anyone of the nuclei usually utilized in the cyanine dyes serving as basic heterocyclic nuclei. To be more concrete, the nuclei applicable thereto include, for example; pyrroline nucleus, oxazoline nucleus, thiazoline nucleus, pyrrole nucleus, oxazole nucleus, thiazole nucleus, selenazole nucleus, imidazole nucleus, tetrazole nucleus and pyridine nucleus; a nucleus whereinto one of the above-given nuclei and an alicyclic hydrocarbon ring are fused, and a nucleus whereinto one of the above-given nuclei and an aromatic hydrocarbon ring are fused, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. The abovegiven nuclei may be substituted on the carbon atom thereof.

To the melocyanine dyes or compound melocyanine dyes, it is allowed to apply, as a nucleus having a ketomethylene structure, a 5- or 6-membered heterocyclic ring nucleus including, for example, a pyrazoline-5-one nucleus, a thiohydantoine nucleus, a 2-thioxazolidine-2,4-dione nucleus, a thiazolidine-2,4-dione nucleus, a rhodanine nucleus and a thiobarbituric acid nucleus.

The sensitizing dyes may be used in an equivalent concentration to those of the sensitizing dyes applicable to the ordinary negative type silver halides. In particular, it is advantageous to use them in the dye-concentration of the order that the inherent sensitivity of a silver halide emulsion may not be lowered substantially. The sensitizing dyes are used in a concentration within the range of, desirably, about $1.0\times10^{-5}$ to about $5\times10^{-4}$ mols and, preferably, about $4\times10^{-5}$ to $2\times10^{-4}$ mols, each per mol of silver halides used.

The sensitizing dyes may be used independently or in combination. The sensitizing dyes advantageously applicable include, for example, the following dyes:

The sensitizing dyes applicable to blue-sensitive silver halide emulsions include, for example; those given in West German Patent No. 929,080; U.S. Pat. Nos. 2,231,658, 2,493,748, 2,503,776, 2,519,001, 2,912,329, 3,656,956, 3,672,897, 3,694,217, 4,025,349 and 4,046,572; British Patent No. 1,242,588; Japanese Patent Examined Publication Nos. 44-14030/1969 and 52-24844/1977; and Japanese Patent O.P.I. Publication Nos. 48-73137/1973 and 61-172140/1986. The sensitizing dyes applicable to green-sensitive silver halide emulsions include, typically, a cyanine dye, a melocyanine dye or a compound cyanine dye, such as those given in, for example; U.S. Pat. Nos. 1,939,201, 2,072,908, 2,739,149 and 2,945,763; British Patent No. 505,979; and Japanese Patent Examined Publication No. 48-42172/1973. The sensitizing dyes applicable to red-sensitive and infrared-sensitive silver halide emulsions include, typically, a cyanine dye, a melocyanine dye or compound cyanine dye such as those given in, for example; U.S. Pat. Nos. 2,269,234, 2,270,378, 2,442,710, 2,454,629 and 2,776,280; Japanese Patent Examined Publication No. 49-17725/1974; and Japanese Patent O.P.I. Publication Nos. 50-62425/1975, 61-29836/1986 and 60-80841/1985.

The above-given sensitizing dyes may be used independently or in combination. The sensitizing dyes are often used in combination particularly for a supersensitization. The typical examples thereof are given in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707; British Patent Nos. 1,344,281 and 1,507,803; Japanese Patent Examined Publication Nos. 43-4936/1968 and 53-2375/1978; and Japanese Patent O.P.I. Publication Nos. 52-10618/1977 and 52-109925/1977.

When containing a dye or a UV absorbent in the hydrophilic colloidal layers of a silver halide photographic light-sensitive material, such dye and UV absorbent may be mordanted with a cationic polymer.

To the above-mentioned photographic emulsions, a variety of compounds may be added for preventing a silver halide photographic light-sensitive material from lowering the sensitivity or from producing a fog, in the course of preparing, storing or processing the light-sensitive material. To be more concrete, it is allowed to add various kinds of compounds having been known as stabilizers including azoles such as a benzothiazolium salt, nitroindazoles, triazoles, benzotriazoles, benzimidazoles such as a nitro- or halogen-substituted matter in particular, hetercyclic mercapto compounds such as mercaptothiazoles, mercaptobenzimidazoles, mercaptothiazoles, mercaptotetrazoles such as 1-phenyl-5-mercaptotetrazole in particular, mercaptopyridines, the above-given heterocyclic ring having such a water-soluble group as a carboxyl group or a sulfone group, mercapto compounds, thioketo compounds such as oxazolinthione, azaindenes including tetrazaindenes such as 4-hydroxy substituted (1,3,3a,7) tetrazaindenes, benzenethiosulfonic acids, and benzenesulfinic acid.

The examples of the compounds applicable thereto are given with the titles of the original literatures in K. Mees, 'The Theory of the Photographic Process', 3rd Ed., 1966.

The typical examples and the methods of application are further detailed in, for example, U.S. Pat. Nos. 3,954,474, 3,982,947 and 4,021,248, or Japanese Patent Examined Publication No. 52-28660/1977.

In the silver halide photographic light-sensitive materials, the photographic component layers thereof are also allowed to contain alkylacrylate type latexes described in U.S. Pat. Nos. 3,411,911 and 3,411,912, and Japanese Patent Examined Publication No. 45-5331/1970.

The silver halide photographic light-sensitive materials may also contain a variety of the following additives. Thickeners or plasticizers including, for example, the substances described in U.S. Pat. No. 2,960,404, Japanese Patent Examined Publication No. 43-4939/1968, West German Patent No. 1,904,604, Japanese Patent O.P.I. Publication No. 48-63715/1973, Belgian Patent No. 762,833, U.S. Pat. No. 3,767,410, and Belgian Patent No. 588,143, such as a styrene-sodium maleate copolymer and dextran sulfate; hardeners including, for example, those of the aldehyde type, epoxy type, ethyleneimine type, active halogen type, vinyl sulfone type, isocyanate type, sulfonic acid ester type, carbodiimide type, mucochloric acid type and acyloyl type; and UV absorbents including, for example, the compounds detailed in U.S. Pat. No. 3,253,921, and British Patent No. 1,309,349, such as, in particular, 2-(2'-hydroxy-5-tertiary butylphenyl)benzotriazole, 2-(2'-hydroxy-3',5'-di-tertiary butylphenyl)benzotriazole, 2-(2-hydroxy-3'-tertiary butyl-5'- butylphenyl)-5-chlorobenzotriazole, and 2-(2'-hydroxy-3', 5'-di-tertiary butylphenyl)-5-chlorobenzotriazole. In addition thereto, coating aids, emulsifiers, permeability improvers for solutions or the like, defoamers, or surfactants for controlling the various physical properties of light-sensitive materials, each applicable thereto, include, for example, the anionic, cationic, non-ionic or amphoteric compounds each described in British Patent Nos. 548,532 and 1,216,389, U.S. Pat. Nos. 2,026,202 and 3,514,293, Japanese Patent Examined Publication Nos. 44-26580/1969, 43-17922/1968, 43-17926/1968, 43-3166/1968 and 48-20785/1973, French Patent No. 202,588, Belgian Patent No. 773,459, and Japanese Patent O.P.I. Publication No. 48-101118/1973. Among them, it is particularly preferable to use the anionic surfactants each having a sulfone group, such as a sulfonated succinic acid ester and a sulfonated alkylbenzene.

The antistatic agents include, for example, the compounds described in Japanese Patent Examined Publication No. 46-24159/1971, Japanese Patent O.P.I. Publication No. 48-89979/1973, U.S. Pat. Nos. 2,882,157 and 2,972,535, Japanese Patent O.P.I. Publication Nos. 48-20785/1973, 48-43130/1973 and 48-90391/1973, Japanese Patent Examined Publication Nos. 46-24159/1971, 46-39312/1971 and 48-43809/1973, and Japanese Patent O.P.I. Publication No. 47-33627/1972.

In preparing a light-sensitive material, the pH values of the coating solutions applicable thereto are preferably within the range of 5.3 to 7.5. In the case of carrying out a multilayer coating, the pH values of the coating solution are preferably within the above-given range of 5.3 to 7.5, provided, the coating solution is prepared by mixing the coating solutions for each layer in a proportion of the amounts to be coated. If the pH is not higher than 5.3, the layers are too slow to be hardened and, if it is not lower than 7.5, there may be some instances where the photographic characteristics may be affected. Both cases are, therefore, not desirable.

The photographic component layers of a light-sensitive material are allowed to contain the following matting agents, for example; the inorganic compounds, namely, silica described in Swiss Patent No. 330,158; glass powder described in French Patent No. 1,296,995; alkaline earth metals or the carbonates of cadmium or zinc, described in British Patent No. 1,173,181; and the organic compounds, namely, starch described in U.S. Pat. No. 2,322,037; the starch derivatives described in Belgian Patent No. 625,451; polyvinyl alcohol described in Japanese Patent Examined Publication No. 44-3643/1969; polystyrene or polymethyl methacrylate described in Swiss Patent No. 330,158; polyacrylonitrile described in U.S. Pat. No. 3,079,257; polycarbonates described in U.S. Pat. No. 3,022,169.

The photographic component layers of the light-sensitive material are also allowed to contain the following lubricants, namely; the higher aliphatic alcohol esters described in U.S. Pat. Nos. 2,588,756 and 3,121,060; casein described in U.S. Pat. No. 3,295,979; higher aliphatic calcium salts described in British Patent No. 1,263,722; and silicon compounds described in British Patent No. 1,313,384 and U.S. Pat. Nos. 3,042,522 and 3,489,567. Besides the above, a liquid paraffin dispersion may also applicable to the same purpose.

To the light-sensitive materials applicable to the invention, a variety of additives may further be used to meet the purposes.

A silver halide photographic light-sensitive material may be prepared, for example, by coating an emulsion layer and the other photographic component layers on the one side or both sides of a flexible support ordinarily used in photographic light-sensitive materials. The useful flexible supports include, for example, semi-synthetic or synthetic high molecular films such as those made of cellulose nitrate, cellulose acetate, cellulose acetobutyrate, polystyrene, polyvinyl chloride, polyethylene terephthalate or polycarbonate; a sheet of baryta paper; and a sheet of paper coated or laminated thereon with $\alpha$-oleffin polymers such as polyethylene, polypropylene and an ethylene/butene copolymer. Such a support may be colored with a dye or pigment. Besides, the supports may also be blackened for shielding light. The surfaces of such a support may generally be subbed for improving the adhesion to an emulsion layer or the like. Such a subbing treatment is preferably made in the methods described in Japanese Patent O.P.I. Publication Nos. 52-104913/1977, 59-18949/84, 59-19940/1984 and 59-11941/1984.

The surfaces of the supports may also be treated in a corona-discharge treatment, a Uv ray irradiation treatment or a flame treatment, before or after the subbing treatment is made.

In the silver halide photographic light-sensitive materials, the photographic emulsion layers and the other hydrophilic colloidal layers thereof may be each coated on a support or the other layer, in a variety of coating methods. The coating methods applicable thereto include, for example, a dip-coating method, a roller-coating method, a curtain-coating method and an extrusion-coating method.

The processing methods of the invention are those for processing a light-sensitive material in the processing steps including a developing step and a fixing step.

Further, the processing methods of the invention are those in which a washing and/or a stabilizing steps are carried out after completing the above-mentioned developing and fixing steps, and the amounts of the replenishers used in the washing and/or stabilizing steps are each not more than 3 liters per sq. meter of the light-sensitive material subject to the processing treatments.

The processing steps preferably carried out in the invention comprise a series of the steps of a developing fixing treatment or a stabilizing drying treatment.

In the processing method of the invention, the amounts of the replenishers used in the washing and/or stabilizing steps to be carried out after completing the developing fixing step are not more than 3 liters per sq. meter of a light-sensitive material subject to the processing treatments. The expression, 'not more than 3 liters' means herein the case where the amounts of the replenishers are nil, that is to say, no replenishment is made.

In the invention, the foregoing dyes of the invention are excellent in solubility and removability, so that an excellent effect may be obtained when adding the replenishers in the above-mentioned amounts. According to the invention, a water consumption may be saved and no piping may be necessarily provided to an automatic processor. Further, the stock reservoirs may be reduced in number. To be more concrete, washing water and, if required, the water for diluting a developer or fixer to be prepared, or a stabilizer, may be supplied from one and single common stock reservoir, so that a compact automatic processor may be designed.

The expression, 'the case where the replenishing amounts of the above-mentioned washing water or stabilizer are nil' herein means the case where a stagnant water washing system is used.

In the washing and/or stabilizing treatments of the invention, the concentration of a calcium compound contained in a replenisher is desirably not more than 10 mg/liter, more desirably, not more than 5 mg/liter, preferably, not more than 3 mg/liter and, particularly, not more than 1 mg/liter, each in terms of calcium ion.

In the washing or stabilizing treatment, the calcium concentration may be adjusted to be the levels mentioned above in a variety of means including, preferably, an ion-exchange resin and/or a reverse osmosing equipment.

As the ion-exchange resins, a variety of cation-exchange resins may be used. Among them, an Na type cation-exchange resins substituted Ca with Na may preferably be used.

Besides, H type cation-exchange resins may also be used. In this case, they are preferably used together with an OH type anion-exchange resin.

Among the ion-exchange resins, a strong acid type cation-exchange resin comprising a styrene-divinyl benzene copolymer as the substrate thereof and a sulfone group as the ion-exchange group thereof may preferably be used. The abovementioned ion-exchange resins include, for example, those under the brand names of Dia-Ion SK-1B and Dia-Ion PK-216 each manufactured by Mitsubishi Chemical Industries Co., Ltd. As the substrates of these ion-exchange resins, those having a proportion of divinyl benzene to be emulsified within the range of 4 to 16% of the whole monomer to be emulsified in preparation. Among the anion-exchange resins applicable in combination with the H type cation-exchange resins, a strong base type anion-exchange resin comprising a styrene-divinyl benzene copolymer as the substrate thereof and a tertiary or quaternary ammonium group as the exchange group thereof may preferably be used. The anion-exchange resins include, for example, those under the brand names of Dia-Ion SA-10A and Dia-Ion PA-418 each manufactured by Mitsubishi Chemical Industries Co., Ltd.

There is no limitation to the reverse osmosing equipments usable therein. It is, however, desirable to use an extra-compact equipment having an area of osmosed layer of not wider than 3 $m^2$ and, preferably, not wider than 2 $m^2$ and an osmotic pressure of not higher than 30 $kg/m^2$ and, preferably, not higher than 20 $kg/m^2$. When using such a compact equipment as mentioned above, the smooth operability and the water-saving effects may satisfactorily be enjoyed. Further, the resins may also be passed through active carbon and a magnetic field.

As the reverse osmotic layers provided to the above-mentioned reverse osmosing equipments, a cellulose acetate layer, an ethyl cellulose polyacrylic acid layer, a polyacrylonitrile layer, a polyvinylene carbonate layer or a polyethersulfone layer may be used.

The pressure applicable to supply a solution is usually within the range of 5 to 60 $kg/cm^2$. For achieving the objects of the invention, it is satisfactory to apply a pressure of not higher than 30 $kg/cm^2$ and, therefore, the so-called low-pressure reverse osmosing equipment for applying a pressure of not higher than 10 $kg/cm^2$ may satisfactorily be used.

The structures of the reverse osmotic layers applicable thereto include, for example, those of the spiral type, a tubular type, a hollow-fiber type, a pleat type and a rod type.

In the foregoing washing and/or stabilizing steps of the invention, the concentration of a magnesium compound contained in a replenisher is, desirably, not higher than 10 mg/l and, preferably, not higher than 5 mg/l, each in terms of magnesium ion.

For adjusting the amount of the magnesium compound contained in the replenisher to be as above, the foreging means for controlling the amount of the calcium compound may similarly be used.

In the invention, the term, 'a washing step' herein means a step in which the components of a processing solution adhered to or adsorbed into a light-sensitive material subject to the treatments, or the components of the light-sensitive material, which are disused in the course of the treatments, are washed with water. Therefore, the washing step may be a step for securing the characteristics of the light-sensitive material even after completing the treatments thereof.

In the invention, the stabilizing step means a step of improving the preservability of an image up to such a level as may not be obtained in the above-mentioned washing step, wherein a solution generally containing a component for functioning an image stabilization is used.

As the washing or stabilizing treatment, anyone of the treatment methods well known in the art may be used. It is also allowed to use water containing various well-known additives as washing water or a stabilizing solution. For example, water given an antimolding means may be used as washing water or a stabilizer. When using water containing an antimolding means in washing water or a stabilizer in combination, a scale production may effectively be prevented. It is allowed to save a water consumption in an amount of water within the range of, for example, 0 to 3 liters and, preferably, 0 to 1 liter, each per sq. meter of a light-sensitive material to be treated.

Among the methods of saving a replenisher consumption, the so-called multistage counter-flow systems such as those of the double- or triple stage type have been known for long. When using this system in the invention, a further effective washing or stabilizing treatment may be performed, because a light-sensitive material is processed with being brought into contact with each of the solutions in order from one stage to the other to the direction of a clean solution which is not contaminated with a fixer. According to this system, the further remarkable effect may be enjoyed, because an unstable thiosulfate or the like may appropriately be removed and the possibility of producing a discoloration or a color fading may also be reduced.

The amount of washing water may also extremely be saved as compared to any other conventional systems.

When washing with a small amount of washing water, it is further desirable to provide a squeeze-roller type washing tank, as described in Japanese Patent Application No. 60-172968/1985.

In addition to the above, an antimolding means may also be provided to a washing or stabilizing beth.

The antimolding means applicable thereto include, for example, the UV-ray irradiation method described in Japanese Patent O.P.I. Publication No. 60-263939/1985, the method using an electric field described in Japanese Patent O.P.I. Publication No. 60-263940/1985, the method of making pure water with an ion-exchange resin described in Japanese Patent O.P.I. Publication No. 61-131632/1986, and the method using a microbiocide described in Japanese Patent O.P.I. Publication Nos. 60-253807/1985, 60-295894/1985, 61-63030/1986 and 61-51398/1986.

It is further allowed to use the microbiocides, antimolds and surfactants each described in L.E. West, 'Water Quality Criteria', Photographic Science & Engineering, Vol. 9, No. 6, 1965; M.W. Beach, 1 Microbiological Growths in Motion-Picture Processing', SMPTE Journal, Vol. 85, 1976; R.O. Deegan, 'Photo Processing Wash Water Biocides', Journal of Imaging Technology, Vol. 10, No. 6, 1984; and Japanese Patent O.P.I. Publication Nos. 57-8542/1982, 57-58143/1982, 58-105145/1983, 57-132146/1982, 58-18631/1983, 57-97530/1982 and 57-157244/1982.

The washing bath is also allowed to make a combination use of the microbiocides including, for example, the following compounds; namely, the isothiazoline type compounds described in R.T. Kreimen, Journal of Imaging Technology, 10, (6), 242, 1984; the isothiazyline type compounds described in Research Disclosure, Vol. 205, Item 20526, May, 1981; the isothiazyline compounds described in ibid., Vol. 228, Item 22845, April, 1983; and the compounds described in Japanese Patent O.P.I. Publication No. 61-51396/1986.

The typical examples of the antimolds include phenol, 4-chlorophenol, pentachlorophenol, cresol, o-phenylphenol, chlorophene, dichlorophene, formaldehyde, glutaraldehyde, chloracetamide, p-hydroxybenzoate, 2-(4-thiazolidine)-benzoimidazole, benzoisothiazoline-3-one, dodecyl-benzyl-dimethyl ammonium chloride, N-(fluorodichloromethylthio)phthalimide, and 2,4,4'-trichloro-2'-hydroxydiphenyl ether.

As the water for diluting the stock processing solutions such as the foregoing developer and fixer, the water provided therein with an antomolding means, which is stored in a water stock reservoir.

A variety of surfactants may be added into the washing water for the purpose of preventing a water-spot production. The surfactants applicable thereto include, for example, those of the positive ion type, negative ion type, non-ion type and amphoteric ion type. The typical examples of the surfactants include those of the compounds given in, for example, 'A Handbook of Surface Active Agents', published by Kohgaku Tosho Co., Ltd.

In the above-described methods, the washing or stabilizing temperature and time are desired to be within the ranges of 0° C. to 50° C. and 5 seconds to 30 seconds, more desirably, 15° C. to 40° C. and 5 seconds to 20 seconds and, preferably, 15° C. to 40° C. and 5 seconds to 10 seconds.

Into the washing water and the replenishers thereof, each applicable to a washing treatment, a microbiocide, such an antimold as given above, or a hard-water softener may be contained. They are, however, not always necessary to be added therein.

Into the stabilizers or the replenishers thereof, each applicable to a stabilizing treatment, the compounds applicable to the washing water or the replenishers thereof may be contained and, besides, a compound generally capable of functioning an image stabilization may also be added therein.

The typical examples thereof include water soluble iodide such as pottasium iodide or anmonium iodide, or heterocyclic mercapt compound such as 1-phenyl-5-mercapttetrazole as disclosed in Japanes Patent O.P.I. No. 114035/1983.

The pH values of the washing water or the stabilizers are within the range of, usually, 4 to 9 and, preferably, 5 to 8; provided, there may be some instances where an acidic stabilizer containing acetic acid having a pH of not higher than 4 may be used.

To the washing or stabilizing step, it is desired to provide a variety of washing accelerating means including, for example, a supersonic oscillation in a solution, an air-bubbling, jet-flow against the surface of a light-sensitive material, and a compression applied by a roller.

Next, the typical examples of the processing steps to be carried out in the method of the invention will be given below.

1 Black-and-white developing—fixing—washing
2. Black-and-white developing—fixing—stabilizing
3. Black-and-white developing—fixing—washing—stabilizing In the above-given processing steps, the steps put in <brackets> may be omitted according to the kinds, purposes and application of light-sensitive materials subject to the processing treatments, however, the washing and stabilizing steps should not be omitted at the same time.

In the invention, at least one of the washing and/or stabilizing steps is carried out after completing the developing and fixing steps. In the invention, each of the fixing time and the developing time is, desirably, not longer than 20 seconds and, preferably, not longer than 15 seconds.

It is also desirable that the processing time, that is so-called a dry-to-dry time, is desirably, not longer than 60 seconds.

When using a black-and-white developer in the developing step of the invention, it is most preferable to make a combination use of a dihydroxybenzene and a 1-phenyl-3-pyrazolidone as the developing agent of the developer, form the viewpoint that an excellent result can be obtained.

Besides the above, it is the matter of course that a p-aminophenol type developing agent may be contained therein.

The dihydroxybenzene type developing agents applicable thereto include, for example, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Among them, hydroquinone is particularly preferable.

The developing agents of the 1-phenyl-3-pyrazolidone and the derivatives thereof each applicable to the invention include, for example, 1-phenyl-4,4-dimethyl-3-pyrazolidone, 1-phenyl-4-methyl-4-hydroxymethyl-3-pyrazolidone, and 1-phenyl-4,4-dihydroxymethyl-3-pyrazolidone.

The p-aminophenol type developing agents applicable to the invention include, for example, N-methyl-p-aminophenol, p-aminophenol, N-(β-hydroxyethyl)-p-aminophenol, N-(4hydroxyphenyl)glycine, 2-methyl-p-aminophenol, and p-benzylaminophenol. Among them, N-methyl-p-aminophenol is particularly preferable.

Such a developing agent as given above is ordinarily used in an amount within the range of, preferably, 0.01 mols/liter to 1.2 mols/liter.

In the invention, sulfite type preservatives may be used. The preservatives include, for example, sodium sulfite, potassium sulfite, lithium sulfite, ammonium sulfite, sodium bisylfite, potassium metabisulfite and sodium bisulfite formaldehyde. The sulfites are added in an amount of not less than 0.2 mols/liter and, preferably, not less than 0.4 mols/liter. It is also preferable that the upper limit of the addition thereof is up to 2.5 mols/liter.

The pH values of the developers applicable to the invention are within the range of, desirably, 9 to 13 and, preferably, 10 to 12.

Any alkalizers may be used to adjust the pH of developers. Such alkalizers include, for example, pH adjusters such as sodium hydroxide, potassium hydroxide, sodium carbonate, potassium carbonate, tertiary sodium phosphate, and tertiary potassium phosphate.

It is also allowed to use the following buffers, namely; the borates described in Japanese Patent O.P.I. Publication No. 61-28708/1986; saccharose, acetoxime and 5-sulfosalicylic acid each described in Japanese Patent O.P.I. Publication No. 60-93439/1985; phosphates; and carbonates.

Besides the above, the additives applicable thereto include, for example; development inhibitors such as sodium bromide and potassium iodide; and antifoggants including, for example, organic solvents such as ethylene glycol, diethylene glycol, triethylene glycol, dimethyl formamide, methyl cellosole, hexylene glycol, ethanol and methanol, mercapto type compounds such as 1-phenyl-5-mercaptotetrazole and sodium 2-mercaptobenzimidazole-5-sulfonate, indazole type compounds such as 5-nitroindazole, and benzotriazole type compounds such as 5-methylbenzotriazole. If required, it is further allowed to contain an image toner, a surfactant, a defoaming agent, a hard-water softener, and the amino compounds described in Japanese Patent O.P.I. Publication No. 56-106244/1981.

In the invention, the developers are allowed to contain a silver-stain inhibitor such as the compounds described in Japanese Patent O.P.I. Publication No. 56-2434/1981.

In the invention, the developers are allowed to contain an amino compound such as alkanolamine described in Japanese Patent O.P.I. Publication No. 56-106244/1981.

Besides the above, it is further allowed to contain those described in F.A. Mason, 'Photographic Processing Chemistry', Focus Press, 1966, pp. 226-229; U.S Pat. Nos. 2,193,015 and 2,592,364; and Japanese Patent O.P.I. Publication No. 48-64933/1973.

In the invention, the terms, 'a developing time' and 'a fixing time', are defined each as a period for which a light-sensitive material subject to the process is being substantially brought into contact with a developer or a fixer and, when using an automatic processor, the terms are defined each as a period from a time at which a light-sensitive material is dipped in the developing tank of the automatic processor to a time at which it is dipped in the fixing tank, and from a time at which it is dipped in the fixing tank to a time at which it is dipped in the successive washing tank or stabilizing tank.

The term, 'a washing time', means a period for which the light-sensitive material is being dipped in a washing tank.

The term, 'a drying time', means a period for which the light-sensitive material is being put in a drying zone provided to the automatic processor so that the hot air may be blown, at a temperature of normally 35° C. to 100° C. and preferably 40° C. to 80° C., against the drying zone.

The developing temperatures and the time therefor are, desirably, within the range of about 25° C. to 50° C. and not longer than 15 seconds and, preferably, within the range of 30° C. to 45° C. and 5 seconds to 15 seconds.

Generally, the fixers are each an aqueous solution desirably containing a thiosulfate, and the pH values thereof are, desirably, not lower than 4.0 and, preferably, within the range of 4.2 to 5.5.

The fixers are those containing sodium thiosulfate or ammonium thiosulfate and, generally, those containing thiosufuric acid ions and ammonium ions. Among them, those containing ammonium thiosulfate is particularly preferable from the viewpoint of the fixing speed. The amounts of the fixing agents to be added in the fixers may be varied to meet the purposes and are, generally, within the range of 0.1 to 0.6 mols/liter.

In the invention, such a fixer as mentioned above is allowed to contain an acidic hardener. The fixers may also be used together with tartaric acid, citric acid or the derivatives thereof independently or in combination. It is generally desirable that these compounds are contained in an amount of not less than 0.005 mols and, particularly, within the range of 0.01 mols to 0.03 mols, each per liter of a fixer to be used, because the compounds are effective when they are contained in the above-given amount.

These components of the fixers include, for example, tartaric acid, potassium tartarate, sodium tartarate, potassium.sodium tartarate, citric acid, sodium citrate, potassium citrate, lithium citrate, and ammonium citrate.

If desired, the fixers are allowed to contain preservatives such as a sulfite and a bisulfite, pH buffers such as acetic acid and nitric acid, pH adjusters such as sulfuric acid, chelating agents such a those capable of displaying a hard-water softening function, and the compounds described in Japanese Patent Application No. 60-213562/1985.

The fixing temperatures and the time therefor are within the range of, desirably, about 20° C. to about 50° C. and not longer than 15 seconds and, preferably, 30° C. to 40°C. and 5 seconds to 15 seconds.

In the case of the embodiment where diluted water of a concentrated fixing solution is used, it is usual to use a dual-kit type concentrated fixing solution. However, a single-kit type one may also be used.

To make a stock solution of the single-kit type fixer stable, the stock solution is to have a pH of, desirably, not lower than 4.5 and, preferably, not lower than 4.65. If the pH thereof is lower than 4.5, it is feared that a thiosulfate is decomposed to finally produce a sulfide particularly when the stock solution is allowed to stand for a long time before it is practically used. When the pH is not lower than 4.5, sulfurous acid gas is produced a little, so that the operational circumstances can be improved. The upper limit of the pH values is not so seriously limitative, however, if the pH is too high in a fixing step, the pH of a layer is raised to increase a layer swelling, so that the drying step is overloaded. Therefore, the pH is desired to be up to about 7.

In the invention, it is the matter of course that the developer and/or fixer may be used even if they are the solution for which any diluted water is not needed, that is to say, the solution to which a replenishment is made by a stock solution as it is. Such a solution as mentioned above is so-called a tank solution.

When using concentrated solutions, the amount thereof supplied to each of the processing tanks and the mixing proportion thereof to diluted water may be varied depending on the compositions of the concentrated solutions. However, the proportion of a concentrated solution to diluted water is generally within the range of, desirably, 1 to 0-8. The whole amounts of the developer and fixer are each desirably from 50 ml to 1500 ml per sq. meter of a light-sensitive material to be processed.

In embodying the invention, a light-sensitive material having been developed, fixed and washed is squeezed to remove the washing water, that is, the embodiment in which the light-sensitive material is dried through a squeeze-roller method.

The drying step may be carried out at a temperature within the range of about 40° C. to about 100° C. The drying time may suitably be changed to meet the surrounding conditions, however, it may be within the range of, normally, about 5 seconds to one minute and, preferably, about 5 seconds to 30 seconds at a temperature within the range of 40° C. to 80° C.

In the invention, it may be displayed a further excellent effect that a drying time may be shortened.

According to the invention, the so-called dry-to-dry processing time from a developing, fixing and washing steps up to a drying step is processed, desirably, within 60 seconds as described above and, preferably, within 50 seconds.

The term, 'a dry-to-dry processing time', herein stated means that a period of time from the moment when the leading edge of a light-sensitive material subject to the treatments is fed into the film-insertion inlet of an automatic processor to be treated to the moment when the leading edge thereof is taken out of the automatic processor.

EXAMPLES

The invention will now be detailed with reference to the examples. It is the matter of course that the invention shall not be limited thereto.

EXAMPLE 1

Under the presence of water-soluble iridium in an amount of $2\times10^{-6}$ mols per mol of silver and water-soluble rhodium in an amount of $4\times10^{-7}$ mols per mol of silver, silver chlorobromide grains having a silver bromide content of 30 mol % was prepared with controlling the EAg to be 120 mV and the pH to be 3.0.

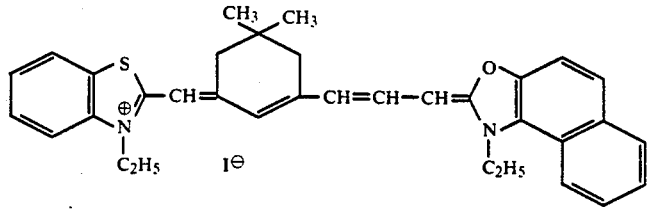

A

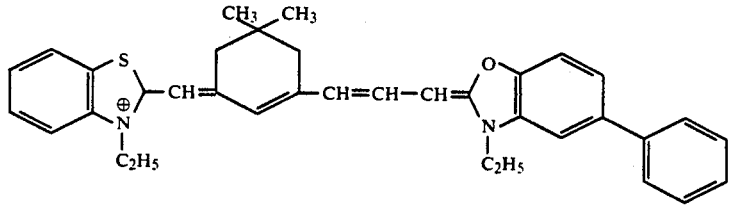

B

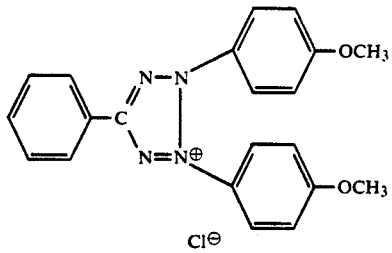

C

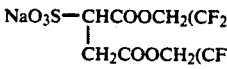

D

The resulting grains were those in the cubic crystal form having an average grain-size of 0.24 μm, and the grain-size distribution thereof was 11% and the ratio of (100) face to (111) face was 95 to 5. To the resulting grains, potassium bromide was added in an amount of 0.6 g per mol of silver halide, and the mixture was subjected to both of the gold-sensitization and the sulfur-sensitization. Then, 20 mg each of sensitizing dyes A and B and, further, 1 g of the stabilizer, namely, 4-hydroxy-6-methyl-1,3,3a,7-tetrazaindene per mol of silver halide, 700 mg of the following compound C, 600 mg of sodium n-dodecyl benzenesulfonate, 2 g of a styrene-maleic acid copolymer and 3 g of the high molecular polymer latex of ethyl acrylate so that the resulting mixture could be coated in a silver content of 3.5 g/m$^2$ and a gelatin content of 1.8 g/m$^2$ on a polyethyleneterephthalate film; and thereby preparing a silver halide emulsion layer. In this instance, a protective layer containing the spreading agent, namely, sodium 1-decyl-2-(3-isopentyl)succinate-2-sulfonate in an amount of 30 mg/m$^2$, the hardener, namely, sodium 1-hydroxy -3,5-dichlorotriazine in an amount of 30 mg/m$^2$, for amount of 25 mg/m$^2$, and the fluorine-containing surfactant D; the protective layer was multicoated on the film on which a backing layer had been coated in advance.

Thereby Sample-1 could be prepared to have the emulsion layer and the surface protective layer on one side of the support and the backing layer on the other side of the support. The backing layer of Sample-1 was added by the comparative dye D in the amount shown in Table-1.

In addition, Sample-2 through Sample-6 were each prepared to have the backing layer containing the dyes of the invention of the kinds and in the amounts shown in Table-1.

The resulting samples were each flash-exposed for $10^{-5}$ seconds to a xenon flash lamp through a contact screen, Grey-Negative 150L, an optical wedge and a Kodak Wratten Filter No. 88A. Experiments No.1 to No. 18 were then tried by processing the samples through the roller-type automatic processor using the developer, fixer and washing water each having the following compositions under the conditions shown in Table-1, and the evaluations thereof were made.

The color residues of the resulting images and the sludge produced in the processing solutions used in the treatments were evaluated in the following manners.

Table-1 shows the results of the evaluations of the treatments.

Color residues : The visual 5-grade evaluations were made, wherein Grade 5 is that no color residue was found; Grade 1 is that a plenty of residues were found; and Grade 3 or over is that the subject samples may be put to practical use.

Sludge production : A series of 300 sheets of film in full 20"×24" size were processed and then the stains produced thereon were checked up.

| Formula of the developer | |
|---|---|
| Composition A | |
| Pure water, ion-exchange water | 150 ml |
| Disodium ethylenediaminetetraacetate | 2 g |
| Diethylene glycol | 50 g |
| Potassium sulfite, in an aqueous 55% solution | 100 ml |
| potassium carbonate | 50 g |
| Hydroquinone | 15 g |
| 5-methylbenzotriazole | 200 mg |
| 1-phenyl-5-mercaptotetrazole | 30 mg |
| Potassium hydroxide | An amount to make the pH of the solution to be 10.4 |
| Potassium bromide | 4.5 g |
| Composition B | |
| Pure water, ion-exchange water | 3 ml |
| Diethylene glycol | 50 g |
| Disodium ethylenediaminetetraacetate | 25 mg |
| Acetic acid, in an aqueous 90% solution | 0.3 ml |
| 5-nitroindazole | 110 mg |
| 1-phenyl-3-pyrazolidone | 700 mg |

When using the developer, Compositions A and B were dissolved in order in 500 ml of water so as to make one liter.

| Formula of the fixer | |
|---|---|
| Composition A | |
| Ammonium thiosulfate, in an aqueous solution of 72.5% w/v | 240 ml |
| Sodium sulfite | 17 g |

-continued

| Formula of the fixer | |
|---|---|
| Sodium acetate.trihydrate | 6.5 g |
| Boric acid | 6 g |
| Sodium citrate.dihydrate | 2 g |
| Acetic acid, in an aqueous 90% w/v solution | 13.6 ml |
| Composition B | |
| Pure water, ion-exchange water | 17 ml |
| Sulfuric acid, in an aqueous 50% w/v solution | 4.7 g |
| Aluminium sulfate, in an aqueous solution of 8.1% w/v in terms of the $Al_2O_3$ content | 26.5 g |
| Washing water, for the mother liquid and replenisher in common | |

I. City water as same as washing water III was passed through a mixed-bed type column filled with an H-type strong acid cation-exchange resin, Amberlite IR-120B manufactured by Rhom & Haas Co., and an OH-type anion-exchange resin, Amberlite IR-400 manufactured by the same company, and water having the following water-quality was used.

| | |
|---|---|
| Calcium | 0.5 mg/liter |
| Magnesium | 0.2 mg/liter |
| pH | 6.8 |
| Electric conductivity | 5.5 μs/cm |

II. Washing water I and city water were mixed and water having the following water-quality was used.

| | |
|---|---|
| Calcium | 2.2 mg/liter |
| Magnesium | 0.7 mg/liter |
| pH | 6.9 |
| Electric conductivity | 27 μs/cm |

III. City water having the following water-quality was used.

| | |
|---|---|
| Calcium | 35 mg/liter |
| Magnesium | 10 mg/liter |
| pH | 6.9 |
| Electric conductivity | 420 μs/cm |

The amounts of the above-given calcium and magnesium are each expressed in terms of calcium ions and magnesium ions.

TABLE 1

| Experiment No. | Sample No. | Dye used Kind | Dye used Amount, mg/m² | Replenisher used | Amount replenished, l/m² | Color residual degree | Degrees of sludges, or the sludge production, in the processing solution used | Invention or Comparison |
|---|---|---|---|---|---|---|---|---|
| 1 | 1 | D | 80 | I | 2.5 | 2 | Not produced | For comparison |
| 2 | | | | | 0.5 | 1 | Produced | For comparison |
| 3 | | | | III | 2.5 | 1 | Produced | For comparison |
| 4 | 2 | 3 | 120 | I | 2.5 | 5 | Not produced | For the invention |
| 5 | | | | | 0.5 | 5 | Not produced | For the invention |
| 6 | | | | II | 2.5 | 5 | Not produced | For the invention |
| 7 | | | | | 0.5 | 4 | Not produced | For the invention |
| 8 | | | | III | 2.5 | 3 | Not produced | For the invention |
| 9 | 3 | 11 | 100 | I | 2.5 | 5 | Not produced | For the invention |
| 10 | | | | | 0.5 | 5 | Not produced | For the invention |
| 11 | | | | II | 2.5 | 4 | Not produced | For the invention |
| 12 | | | | | 0.5 | 4 | Not produced | For the invention |
| 13 | | | | III | 2.5 | 3 | Not produced | For the invention |
| 14 | 4 | 19 | 110 | I | 2.5 | 5 | Not produced | For the invention |
| 15 | | | | III | 2.5 | 3 | Not produced | For the invention |
| 16 | 5 | 20 | 100 | I | 2.5 | 5 | Not produced | For the invention |

TABLE 1-continued

| Experiment No. | Sample No. | Dye used Kind | Dye used Amount, mg/m² | Replenisher used | Amount replenished, l/m² | Color residual degree | Degrees of sludges, or the sludge production, in the processing solution used | Invention or Comparison |
|---|---|---|---|---|---|---|---|---|
| 17 | | | | III | 2.5 | 3 | Not produced | For the invention |
| 18 | 6 | 29 | 110 | I | 2.5 | 5 | Not produced | For the invention |

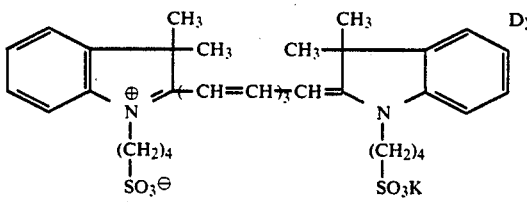

Dye D

As can be understood from Table-1, when the processing method of the invention was applied to the samples of the light-sensitive materials colored with the dyes, in other words, in the cases of Experiments No. 4 through No. 18, the treatments in which the color residues could be inhibited and no stain could be produced with any sludges. In the method for comparison, on the other hand, in other words, in the cases of Experiments No 1 through No. 3, the color residues raised the problems and the stains were produced with sludges.

What is claimed is:

1. A method for processing a light-sensitive silver halide photographic material comprising: developing, fixing and washing or stabilizing the light-sensitive material, wherein the washing or stabilizing time is not longer than 15 seconds and wherein a replenishing solution for the washing or stabilizing is in an amount of not more than 3 liters per square meter of the light-sensitive material, which photographic material comprises a support, and a hydrophilic colloidal layer on each side of the support, wherein either one of the hydrophilic colloidal layers contains a dye represented by the following formulas Ia, Ib or Ic

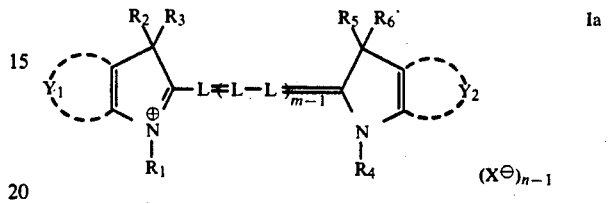

Ia

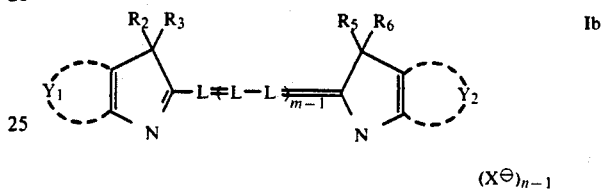

Ib

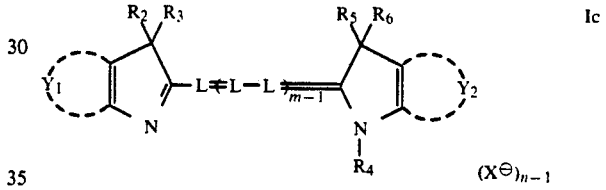

Ic wherein $R_1$, $R_2$, $R_3$, $R_4$, $R_5$ and $R_6$ each represent an alkyl group; $Y_1$ and $Y_2$ each represent a group consisting of non-metal atoms necessary to form a pyrrolopyridine ring, with the proviso that in the formulas Ib and Ic $Y_1$ and $Y_2$ contain a bond of

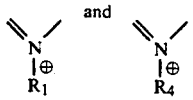

respectively L is a methine group; X- is an anion; m is an integer of 4 or 5; n is an integer of 1 or 2, provided that n is 1 when the dye forms an intramolecular salt; wherein at least two of $R_1$, $R_2$, $R_3$, $R_4$, $R_5$, $R_6$, $Y_1$ and $Y_2$ are acid groups or at least two of $R_1$, $R_2$, $R_3$, $R_4$, $R_5$, $R_6$, $Y_1$ and $Y_2$ are substituents having at least one of group of the formula $—CH_2CH_2OR$ in which R is a hydrogen atom or an alkyl group; and wherein the side of the light sensitive material having the hydrophilic colloidal layer containing the dye has a gelatin content of not more than 3.0 g/m2.

* * * * *